US011535943B2

(12) United States Patent
Takeda et al.

(10) Patent No.: US 11,535,943 B2
(45) Date of Patent: Dec. 27, 2022

(54) GRAIN-ORIENTED ELECTRICAL STEEL SHEET

(71) Applicant: NIPPON STEEL CORPORATION, Tokyo (JP)

(72) Inventors: Kazutoshi Takeda, Tokyo (JP); Tomoya Suenaga, Tokyo (JP); Shuichi Yamazaki, Tokyo (JP); Masaru Takahashi, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 74 days.

(21) Appl. No.: 16/343,452

(22) PCT Filed: Oct. 31, 2017

(86) PCT No.: PCT/JP2017/039375
§ 371 (c)(1),
(2) Date: Apr. 19, 2019

(87) PCT Pub. No.: WO2018/079845
PCT Pub. Date: May 3, 2018

(65) Prior Publication Data

US 2019/0271087 A1 Sep. 5, 2019

(30) Foreign Application Priority Data

Oct. 31, 2016 (JP) ..... JP2016-213783

(51) Int. Cl.

| | |
|---|---|
| ***C21D 3/04*** | (2006.01) |
| ***C23F 11/18*** | (2006.01) |
| ***C21D 6/00*** | (2006.01) |
| ***C21D 8/12*** | (2006.01) |
| ***C21D 9/46*** | (2006.01) |
| ***C22C 38/00*** | (2006.01) |
| ***C22C 38/02*** | (2006.01) |
| ***C22C 38/06*** | (2006.01) |
| ***C23C 22/00*** | (2006.01) |
| *H01F 1/147* | (2006.01) |

(52) U.S. Cl.
CPC ..... *C23F 11/184* (2013.01); *C21D 3/04* (2013.01); *C21D 6/008* (2013.01); *C21D 8/12* (2013.01); *C21D 8/1222* (2013.01); *C21D 8/1255* (2013.01); *C21D 9/46* (2013.01); *C22C 38/00* (2013.01); *C22C 38/001* (2013.01); *C22C 38/02* (2013.01); *C22C 38/06* (2013.01); *C23C 22/00* (2013.01); *H01F 1/147* (2013.01)

(58) Field of Classification Search
CPC ..... C23F 11/184; C21D 3/04; C21D 6/008; C21D 8/12; C21D 8/1222; C21D 8/1255; C21D 9/46; H01F 1/147; H01F 1/14783; C22C 38/00; C22C 38/001; C22C 38/02; C22C 38/06; C23C 22/00
USPC ..... 428/688
See application file for complete search history.

(56) References Cited

U.S. PATENT DOCUMENTS

| | | | | |
|---|---|---|---|---|
| 2009/0233114 | A1 | 9/2009 | Takeda et al. | |
| 2010/0206437 | A1 | 8/2010 | Takashima et al. | |
| 2011/0067786 | A1 | 3/2011 | Takashima et al. | |
| 2013/0000786 | A1 | 1/2013 | Murakami et al. | |
| 2014/0377573 | A1* | 12/2014 | Okubo | H01F 1/14783 148/111 |
| 2015/0010762 | A1 | 1/2015 | Yamaguchi et al. | |
| 2015/0170812 | A1 | 6/2015 | Murakami et al. | |
| 2016/0230240 | A1 | 8/2016 | Senda et al. | |

FOREIGN PATENT DOCUMENTS

| | | | |
|---|---|---|---|
| EP | 1 811 053 | A1 | 7/2007 |
| JP | 53-28375 | B | 8/1978 |
| JP | 57-9631 | B2 | 2/1982 |
| JP | 1-147074 | A | 6/1989 |
| JP | 7-268567 | A | 10/1995 |
| JP | 11-71683 | A | 3/1999 |
| JP | 2000-178760 | A | 6/2000 |
| JP | 2007-23329 | A | 2/2007 |
| JP | 2007-217758 | A | 8/2007 |
| JP | 2009-57591 | A | 3/2009 |
| JP | 2010-13692 | A | 1/2010 |
| JP | 2012-158799 | A | 8/2012 |
| JP | 5063902 | B2 | 10/2012 |
| JP | 2015-168869 | A | 9/2015 |

(Continued)

OTHER PUBLICATIONS

Machine Translation of JP 2007-217758 (Year: 2007).*
Asbury Online, "Boron Nitride Powder & Coatings", 2015 (Year: 2015).*
Murali et al. "Formulation and Tape Casting of Hexagonal Boron Nitride Suspensions", 2015 (Year: 2015).*
Lower Friction "Hexagonal Boron Nitride (hBN) Powder", 2021 (No public availability available) (Year: 2021).*
MarkNature "Hexagonal Boron Nitride", 2022 (Year: 2022).*

(Continued)

*Primary Examiner* — Daniel J. Schleis
(74) *Attorney, Agent, or Firm* — Birch, Stewart, Kolasch & Birch, LLP

(57) ABSTRACT

A grain-oriented electrical steel sheet has a steel sheet and an insulating coating which is formed on a surface of the steel sheet. In the insulating coating, a metal phosphate and a colloidal silica are contained, the colloidal silica is contained in an amount of 20 to 150 parts by mass with respect to 100 parts by mass of the metal phosphate, one or more kinds of fine particles selected from the group consisting of silicon carbide, silicon nitride, aluminum nitride, boron nitride, sialon, and cordierite are further contained in an amount of 0.5 to 7 parts by mass with respect to 100 parts by mass of the metal phosphate, an average particle size of the fine particles is 0.3 to 7.0 μm, crystallized ratio of the metal phosphate is 2% to 40%, and chromium is not contained.

10 Claims, No Drawings

(56) References Cited

FOREIGN PATENT DOCUMENTS

| | | | |
|---|---|---|---|
| JP | 2016-176138 | A | 10/2016 |
| KR | 10-2016-0044596 | A | 4/2016 |
| RU | 2407818 | C2 | 12/2010 |
| RU | 2431697 | C1 | 10/2011 |
| RU | 2497956 | C1 | 11/2013 |
| RU | 2576355 | C1 | 2/2016 |
| RU | 2593051 | C1 | 7/2016 |

OTHER PUBLICATIONS

Extended European Search Report for corresponding European Application No. 17864894.5, dated May 14, 2020.
International Search Report for PCT/JP2017/039375 dated Dec. 12, 2017.
JIS B 0601, 2013, total 129 pages.
JIS C 2550, 2011, total 477 pages.
Written Opinion of the International Searching Authority for PCT/JP2017/039375 (PCT/ISA/237) dated Dec. 12, 2017.
Indian Office Action, dated Jan. 27, 2020, for corresponding Indian Application No. 201917020637, with an English translation.
Russian Office Action and Search Report, dated Feb. 10, 2020, for corresponding Russian Application No. 2019113767, with an English translation.

* cited by examiner

GRAIN-ORIENTED ELECTRICAL STEEL SHEET

TECHNICAL FIELD OF THE INVENTION

The present invention relates to a grain-oriented electrical steel sheet, and particularly, to a grain-oriented electrical steel sheet having a chromium-free insulating coating. Priority is claimed on Japanese Patent Application No. 2016-213783, filed on Oct. 31, 2016, the content of which is incorporated herein by reference.

RELATED ART

In some cases, a grain-oriented electrical steel sheet has an insulating coating having a forsterite layer and a phosphate coating layer on a surface thereof. To form the forsterite layer, a slab is hot rolled to obtain a hot rolled steel sheet, and then the steel sheet is cold rolled (in some cases, the hot rolled steel sheet is annealed, and then cold rolled), and subjected to decarburization annealing. After that, magnesia coating is performed on a surface, and then high-temperature final annealing is performed.

To form the phosphate coating layer, after the high-temperature final annealing for forming a forsterite layer, flattening and coating with a treatment liquid containing a phosphate and the like as main components are performed, and then baking is performed. The flattening and the coating with a treatment liquid containing a phosphate and the like as main components may be performed at the same time or separately.

The forsterite layer is positioned between the steel sheet and the phosphate coating layer, and contributes to an improvement in adhesion between the steel sheet and the phosphate coating layer as an intermediate layer.

The phosphate coating layer also called a secondary coating imparts insulation properties to the electrical steel sheet to reduce eddy current loss, thereby improving iron loss and improving the energy efficiency of the electric device.

However, in a case where the electrical steel sheet has inferior workability, heat resistance, and slipperiness during the manufacturing of an iron core of a transformer or the like by processing the electrical steel sheet, the insulating coating may be peeled off during stress relief annealing. In this case, there is a concern that the insulation properties may be reduced and the efficiency of the electric device may thus be reduced. In addition, in a case where these characteristics are inferior, it takes time to laminate the electrical steel sheet during the manufacturing of an iron core, and workability and assembling efficiency deteriorate.

Therefore, in recent years, various characteristics (coating characteristics) such as corrosion resistance, heat resistance, slipperiness, and workability other than insulation properties have been required for the phosphate coating layer.

It has been known that the insulating coating of the grain-oriented electrical steel sheet has effects that magnetic characteristics of the grain-oriented electrical steel sheet are improved by applying a surface tension other than the above properties to the electrical steel sheet. Iron loss of the electrical steel sheet to which the tension is applied is reduced since magnetic domain wall movement is facilitated. In a transformer having an iron core manufactured from a grain-oriented electrical steel sheet, magnetostriction which is one main causes of noise is reduced due to a reduction in iron loss of the grain-oriented electrical steel sheet.

For example, Patent Document 1 discloses a method in which iron loss and magnetostriction of the grain-oriented electrical steel sheet are reduced by applying an insulating coating treatment liquid having a specific composition and containing a phosphate, a chromate, and a colloidal silica as main components to a forsterite layer formed on a surface of a steel sheet after final annealing, and baking it to form an insulating coating (high tensile strength insulating coating) applying a high tension to the steel sheet to thus reduce.

Patent Document 2 discloses a grain-oriented electrical steel sheet which has a high tensile strength insulating coating formed by adhering a specific amount of a treatment liquid containing a phosphate, a chromate, and a colloidal silica having a glass transition point of 950° C. to 1,200° C. as main components.

According to the technologies disclosed in Patent Documents 1 and 2, an insulating coating having a high coating tension (an action of applying a tension to the steel sheet) and excellent various coating characteristics is obtained. However, a chromate, which is a chromium compound, is contained in any of the insulating coatings. In recent years, it has been required to prohibit or restrict using chromates as an environmental problem.

As a technology for manufacturing an insulating coating not containing a chromate, Patent Document 3 discloses a method of forming an insulating coating, including applying a coating treatment liquid containing 20 parts by weight of $SiO_2$ as colloidal silica, 10 to 120 parts by weight of aluminum phosphate, 2 to 10 parts by weight of boric acid, 4 to 40 parts by weight of one or two selected from the group consisting of sulfates of Mg, Al, Fe, Co, Ni, and Zn to a steel sheet, and performing baking at a temperature of 300° C. or higher.

Patent Document 4 discloses a technology related to a chromium-free surface treatment agent for a grain-oriented electrical steel sheet which contains one or more organic acid salts selected from the group consisting of a formate, an acetate, an oxalate, a tartrate, a lactate, a citrate, a succinate, and a salicylate as an organic acid salt selected from the group consisting of Ca, Mn, Fe, Zn, Co, Ni, Cu, B, and Al.

However, the method of Patent Document 3 has a problem in that the corrosion resistance of the insulating coating is reduced due to sulfate ions in the sulfate. In addition, the surface treatment agent of Patent Document 4 has a problem in discoloration of the insulating coating and liquid stability due to the organic acid in the organic acid salt, and further improvements are required.

Patent Document 5 discloses a grain-oriented electrical steel sheet which contains a phosphate and a colloidal silica as main components, and in which the metal component in the phosphate contains a specific amount of a divalent metal element, a specific amount of a trivalent metal element, and a specific amount of a tetravalent metal element.

However, the technology described in Patent Document 5 has a problem in that the stability of the coating treatment liquid is reduced since various metal components are mixed.

Patent Document 6 discloses a grain-oriented electrical steel sheet having a chromium-free high tensile strength insulating coating which contains a phosphate and a colloidal silica as main components, and in which the crystallized ratio of the phosphate is limited within a specific range.

The technology described in Patent Document 6 has no problem such as a reduction in stability of the coating treatment liquid. However, in the technology described in Patent Document 6, there are limits in baking conditions. Therefore, it is difficult to stably form a coating, and thus there is a problem in that industrial productivity is reduced.

Patent Document 7 discloses a treatment liquid for a chromeless tension coating obtained by mixing a nitrogen-containing compound with a mixture of a phosphate and a colloidal silica such that the ratio of nitrogen to phosphorus in the coating is not less than a specific value. In addition, Patent Document 7 discloses that a chromeless tension coating having both excellent moisture absorption resistance and a sufficient iron loss reduction effect can be obtained without the need of specially optimizing a base coating by coating on a surface of a grain-oriented electrical steel sheet after final annealing and baking at 350° C. to 1,100° C.

However, in the technology described in Patent Document 7, the mechanism that contributes to the development of the effect is not clear. Particularly, the lower limit of the baking temperature range is set to 350° C. or higher, but it is doubtful whether the desired effect can be obtained at such a low baking temperature, and there are many other unknown points.

PRIOR ART DOCUMENT

Patent Document

[Patent Document 1] Japanese Examined Patent Application, Second Publication No. S53-28375
[Patent Document 2] Japanese Unexamined Patent Application, First Publication No. H11-071683
[Patent Document 3] Japanese Examined Patent Application, Second Publication No. S57-9631
[Patent Document 4] Japanese Unexamined Patent Application, First Publication No. 2000-178760
[Patent Document 5] Japanese Unexamined Patent Application, First Publication No. 2010-13692
[Patent Document 6] Japanese Unexamined Patent Application, First Publication No. 2007-217758
[Patent Document 7] Japanese Unexamined Patent Application, First Publication No. 2012-158799

DISCLOSURE OF THE INVENTION

Problems to be Solved by the Invention

The invention is contrived in view of the above-described circumstances. An object of the invention is to provide a grain-oriented electrical steel sheet which has a chromium (particularly, chromium compound)-free insulating coating having good adhesion and corrosion resistance and capable of applying a significantly higher tension to the steel sheet than in conventional cases, and has good magnetic characteristics.

Means for Solving the Problem

In order to achieve the object, the gist of the invention is as follows.

(1) A grain-oriented electrical steel sheet having: a steel sheet; and an insulating coating which is formed on a surface of the steel sheet, in which in the insulating coating, a metal phosphate and a colloidal silica are contained, the colloidal silica is contained in an amount of 20 to 150 parts by mass with respect to 100 parts by mass of the metal phosphate, one or more kinds of fine particles selected from the group consisting of silicon carbide, silicon nitride, aluminum nitride, boron nitride, sialon, and cordierite are further contained in an amount of 0.5 to 7 parts by mass with respect to 100 parts by mass of the metal phosphate, an average particle size of the fine particles is 0.3 to 7.0 μm, crystallized ratio of the metal phosphate is 2% to 40%, and chromium is not contained.

(2) In the grain-oriented electrical steel sheet according to (1), the metal phosphate may be one or more of metal salts selected from the group consisting of Al, Ba, Co, Fe, Mg, Mn, Ni, and Zn.

(3) In the grain-oriented electrical steel sheet according to (1) or (2), an arithmetic average roughness Ra of the insulating coating may be within a range of 0.1 to 0.4 μm in a rolling direction, and may be within a range of 0.3 to 0.6 μm in a direction perpendicular to the rolling direction.

(4) In the grain-oriented electrical steel sheet according to any one of (1) to (3), the steel sheet may contain 0.005% or less of C and 2.5% to 7.0% of Si in terms of mass %, and in a structure of the steel sheet, an average grain size may be 1 to 10 mm, and crystal orientation may have a deviation of orientation of 8° or less on average in a rolling direction with respect to (110)[001] orientation.

(5) The grain-oriented electrical steel sheet according to any one of (1) to (4) may further have a forsterite layer which is provided between the steel sheet and the insulating coating.

Effects of the Invention

According to the aspect of the invention, it is possible to provide a grain-oriented electrical steel sheet which has an insulating coating having good adhesion and corrosion resistance and capable of applying a significantly higher tension to the steel sheet than in conventional cases despite not containing chromium, and has good magnetic characteristics.

Embodiments of the Invention

As described above, in a grain-oriented electrical steel sheet to which a tension is applied, magnetic domain wall movement is facilitated, and thus iron loss is reduced. For applying a tension to the steel sheet from the insulating coating of the grain-oriented electrical steel sheet, providing a difference in thermal expansion coefficient between the steel sheet and the insulating coating is effective. In a case where the coefficient of thermal expansion of the insulating coating is smaller than that of the steel sheet, constriction of the steel sheet is larger than constriction of the insulating coating during the baking of the insulating coating. As a result, the steel sheet receives tensile stress, while compressive stress is applied to the coating. Therefore, by reducing the thermal expansion coefficient of the insulating coating, the tensile stress (tension) to be applied to the steel sheet can be increased.

In a case where the insulating coating is peeled off from the steel sheet, the tension to be applied to the steel sheet is reduced. Therefore, excellent adhesion to the steel sheet is required for the insulating coating of the grain-oriented electrical steel sheet. A mixture of a metal phosphate, a colloidal silica, and a chromate has been generally used as a material for forming an insulating coating to improve the adhesion.

Methods of increasing the adhesion of an insulating coating by adding a chromate have been known. When mixing a relatively large amount of a colloidal silica with a metal phosphate, it has been difficult to obtain an insulating coating having a high tension application effect only with the metal phosphate and the colloidal silica without adding chromium.

Therefore, the inventors have conducted intensive studies to obtain an insulating coating which can apply a high tension necessary for a grain-oriented electrical steel sheet to the steel sheet and which does not contain chromium considering environmental problems. As a result, it has been found that in an insulating coating containing a metal phosphate and a colloidal silica as main components, the crystallized ratio of the metal phosphate significantly relates to the coefficient of thermal expansion of the insulating coating, and by controlling the crystallized ratio of the metal phosphate to 40% or less, it is possible to significantly increase the coating tension while maintaining the adhesion. Furthermore, the inventors have found that the coating tension can be further improved by adding predetermined fine particles to the insulating coating.

The mechanism in which the coating tension is significantly improved by mixing fine particles in the insulating coating is not clear in detail. However, as a result of intensive studies on the reactivity of the metal phosphate, the inventors have found that by introducing a specific amount of highly stable fine particles to the metal phosphate and the colloidal silica which are mixed at a specific mixing ratio, the metal phosphate is appropriately crystallized, and the formation of a coating of the colloidal silica is promoted. Accordingly, it is thought that the coating tension is significantly improved by mixing fine particles in the insulating coating.

Hereinafter, a grain-oriented electrical steel sheet according to an embodiment of the invention (grain-oriented electrical steel sheet according to this embodiment) will be described.

A grain-oriented electrical steel sheet according to this embodiment has a steel sheet and an insulating coating formed on a surface of the steel sheet. The insulating coating contains a metal phosphate and a colloidal silica as main components. The colloidal silica is contained in an amount of 20 to 150 parts by mass with respect to 100 parts by mass of the metal phosphate. Furthermore, one or more kinds of fine particles selected from the group consisting of silicon carbide, silicon nitride, aluminum nitride, boron nitride, sialon, and cordierite are contained in an amount of 0.5 to 7 parts by mass with respect to 100 parts by mass of the metal phosphate. The average particle size of the fine particles is 0.3 to 7.0 μm, and the crystallized ratio of the metal phosphate is 2% to 40%. The insulating coating does not contain chromium.

The insulating coating is formed by applying a treatment agent containing a metal phosphate, a colloidal silica, and fine particles (hereinafter, may be referred to as treatment agent) to the surface of the steel sheet and by performing annealing.

The insulating coating is a high tension insulating coating which applies a high tension to the steel sheet.

<Metal Phosphate>

An effect is obtained in a case where the insulating coating contains a metal phosphate. The metal phosphate is preferably a metal salt of any one of Al, Ba, Co, Fe, Mg, Mn, Ni, and Zn, and is more preferably a metal salt of any one of Al, Mg, Mn, Ni, and Zn. The insulating coating may contain these metal salts singly, or may contain a mixture of two or more kinds. In a case where the insulating coating contains a metal salt having a low solubility such as a Ba phosphate, a Ni phosphate, or a Co phosphate, these metal salts may be contained in the treatment agent through any one of a method of adding the metal salts to the treatment agent as an acidic solution, a method of preparing a colloidal solution with the metal salts, and a method of preparing a dispersion with the metal salts, and the treatment agent may be applied to the surface of the steel sheet, and then subjected to annealing.

<Colloidal Silica>

The colloidal silica is not particularly limited.

However, in a case where the average particle size of the colloidal silica is 5 nm or greater, good stability is obtained in a case where the colloidal silica is added to the treatment agent, and the colloidal silica can be uniformly dispersed in the insulating coating. In a case where the average particle size is 50 nm or less, reactivity with the phosphate is good in a case where annealing is performed after application of the treatment agent, and it is possible to sufficiently increase the chemical stability of the metal phosphate. As a result, the moisture absorption resistance of the insulating coating is improved. Therefore, the average particle size of the colloidal silica is preferably 5 nm to 50 nm, and more preferably 6 nm to 15 nm.

In addition, regarding the kind of the colloidal silica, any one of alkaline, neutral, and acidic solutions can be used, but a colloidal silica with a surface subjected to an Al treatment is particularly preferable due to excellent solution stability.

In addition, the shape of a colloidal silica particle is not particularly limited, but from the viewpoint of film formability, amorphous or the shape in which bead-like particles are continued, is preferable.

Regarding the presence ratio between the metal phosphate and the colloidal silica in the insulating coating, the colloidal silica is contained within a range of 20 to 150 parts by mass with respect to 100 parts by mass of the metal phosphate.

In a case where the amount of the colloidal silica mixed is less than 20 parts by mass with respect to 100 parts by mass of the metal phosphate, a sufficient tension application effect is not obtained. In a case where the amount of the colloidal silica mixed is greater than 150 parts by mass, the crystallized ratio of the insulating coating excessively increases, and defects such as cracking and peeling are likely to occur in the insulating coating. Preferably, the colloidal silica is mixed in an amount of 35 to 90 parts by mass with respect to 100 parts by mass of the metal phosphate. More preferably, the colloidal silica is mixed in an amount of 40 to 55 parts by mass with respect to 100 parts by mass of the metal phosphate. The presence ratio between these components in the insulating coating is equal to the mixing ratio in the treatment agent for forming an insulating coating.

<Crystallized Ratio of Metal Phosphate in Insulating Coating: 2% to 40%>

In a case where the crystallized ratio of the metal phosphate is low, a coating having a smooth surface, a high coating tension, and excellent corrosion resistance can be obtained. However, in a case where the crystallized ratio of the metal phosphate is less than 2%, depending on the kind of the metal phosphate, a polycondensation reaction proceeds even after the formation of the insulating coating. As a result, an excessive amount of phosphoric acid is formed, and thus moisture absorption is performed, or the corrosion resistance of the insulating coating deteriorates in some cases. Therefore, the crystallized ratio of the metal phosphate is 2% or greater. In a case where the crystallized ratio is greater than 40%, there is a concern that the coating tension may deteriorate. Therefore, the crystallized ratio of the metal phosphate is 40% or less. The crystallized ratio of the metal phosphate is more preferably within a range of 5% to 20%.

The crystallized ratio of the metal phosphate can be easily calculated by analyzing the grain-oriented electrical steel sheet having an insulating coating formed thereon by using an X-ray structural analysis device. To calculate the crystallized ratio by an X-ray diffraction method, a profile fitting method (profile fitting by peak separation) may be used. In this case, specifically, from the peaks of the amorphous component and the crystalline component in the obtained diffraction diagram, the background is separated, and the respective scattering intensities are obtained to calculate crystallized ratio X (%) using Expression (1). In this case, since the colloidal silica also contains the amorphous component, amorphous scattering intensity A is corrected by calculating the contribution of an amorphous halo from the colloidal silica content.

$$X=C/(C+A)\times 100 \quad (1)$$

C: crystalline scattering intensity A: amorphous scattering intensity

<Fine Particles>

The insulating coating contains one or more kinds of fine particles selected from the group consisting of silicon carbide, silicon nitride, aluminum nitride, boron nitride, sialon, and cordierite. As the fine particles to be added and contained, any of the above-described fine particles may be used singly, or a mixture of two or more kinds may be used. Otherwise, the fine particles may be used after being partially mixed with an organic material with a stabilizer or the like.

In the past, treatment agents were unstable in some cases when various metal phosphates having valences of two, three, and four were mixed in the treatment agent. However, in this embodiment, the coating treatment liquid has good stability since one or more kinds of fine particles having a specific particle size, selected from the group consisting of silicon carbide, silicon nitride, aluminum nitride, boron nitride, sialon, and cordierite, are added to the treatment agent. In addition, since the crystallized ratio of the metal phosphate can be controlled by adding the fine particles in the insulating coating, an insulating coating with a high coating tension is obtained. The slipperiness of the insulating coating film is also improved by adding the fine particles in the insulating coating.

Any of these fine particles has a low coefficient of thermal expansion and a symmetrical crystal structure such as a hexagonal or cubic crystal structure. It is preferable that the crystal system of one or more kinds of fine particles selected from the group consisting of silicon carbide, silicon nitride, aluminum nitride, boron nitride, sialon, and cordierite is hexagonal or cubic since further crystallization of the metal phosphate can be expected. It is more preferable that the fine particles are hexagonal boron nitride, aluminum nitride, or cordierite particles.

The presence ratio of the fine particles in the insulating coating is within a range of 0.5 to 7 parts by mass with respect to 100 parts by mass of the metal phosphate. In a case where the presence ratio of the fine particles is less than 0.5 parts by mass, the effect of crystallizing the metal phosphate cannot be sufficiently obtained. In a case where the presence ratio of the fine particles is greater than 7 parts by mass, there is a concern that the fine particles may aggregate and the uniformity of the insulating coating may be reduced. Therefore, the presence ratio of the fine particles is 0.5 to 7 parts by mass with respect to 100 parts by mass of the metal phosphate. The presence ratio is preferably 1 to 7 parts by mass, and more preferably 1 to 5 parts by mass.

The presence ratio of the fine particles in the insulating coating can be obtained by the following method.

That is, an insulating coating of a certain area is peeled from the steel sheet, the weight of the peeled insulating coating is measured, and then the peeled insulating coating is dissolved in an alkaline solution to separate fine particles which are difficult to dissolve in the alkaline solution. By measuring the weight of the separated fine particles and obtaining the ratio of the weight of the separated fine particles to the weight of the insulating coating measured in advance (weight method), the presence ratio of the fine particles in the insulating coating can be obtained.

The particle size of the fine particles is within a range of 0.3 μm to 7.0 μm in terms of volume-based average particle size. In a case where the average particle size of the fine particles is less than 0.3 μm, aggregation easily occurs in the treatment agent, and there is a concern that the fine particles may be non-uniformly distributed in the insulating coating. In a case where the average particle size is greater than 7.0 μm, the thickness of the insulating coating increases, and there is a concern that in a case where the grain-oriented electrical steel sheet is made into an iron core, the space factor of the steel sheet may be reduced. The average particle size is preferably within a range of 0.3 μm to 2.0 μm.

The average particle size of the fine particles can be obtained by a microtrack method. The microtrack method is also called a laser diffraction method or a laser diffraction and scattering method. In the measurement, an ultrasonic wave pretreatment is performed for 5 minutes to dissociate pseudo-aggregation, the transmittance is set to 80% to 90% for measurement and then measurement is performed. Regarding the refractive index, in a case where there is a known numerical value, the known numerical value may be used. However, in a case where the refractive index is not known, the measurement is performed three or more times with different refractive indices, and a refractive index with which the shape of the particle size distribution is most matched with those of other measurement principles is employed.

In the past, non-colloidal particles were added to a chromium-containing insulating coating in some cases in order to improve the slipperiness of the insulating coating. However, there has been no report that particles are added to improve the coating tension. In addition, a chromium-containing insulating coating and a chromium-free insulating coating have completely different properties. Therefore, even in a case where the above-described fine particles are simply contained in a chromium-free insulating coating, it is not easy for the fine particles having a particle size and a presence ratio as shown in this embodiment to be dispersed in the insulating coating.

In the insulating coating of the grain-oriented electrical steel sheet according to this embodiment, fine particles having a predetermined particle size are contained at a predetermined presence ratio by adjusting baking conditions or the like for insulating coating, or by using an appropriate surfactant according to the kind of fine particles to be contained.

The insulating coating of the grain-oriented electrical steel sheet according to this embodiment does not contain chromium. This means that the chromium content is below the detection limit (at most less than 10 ppm).

The adhered amount of the insulating coating is preferably 2 to 7 g/m$^2$. In a case where the adhered amount is 2 g/m$^2$ or greater, a sufficient tension is applied to the steel sheet, and thus the magnetic characteristic improvement effect is improved. In addition, insulation properties, corrosion resistance, and the like of the insulating coating are also improved. In addition, in a case where the adhered amount of the insulating coating is 7 g/m$^2$ or less, it is possible to prevent the space factor of the steel sheet from being reduced in a case where the grain-oriented electrical steel sheet is made into an iron core of a transformer.

The surface of the insulating coating (insulating coating according to this embodiment) of the grain-oriented electrical steel sheet according to this embodiment has irregularities that are presumed to be formed due to the presence of the fine particles. Due to the irregularities, the insulating coating has a predetermined surface roughness.

By presence of the irregularities on the surface, the slipperiness of the insulating coating during the manufacturing of an iron core is improved, and the space factor of the steel sheet in the iron core is also improved. In a case where an arithmetic average roughness (Ra) in a rolling direction is 0.1 μm or greater and an arithmetic average roughness (Ra) in a direction perpendicular to the rolling direction is 0.3 μm or greater, the slipperiness is improved, and the productivity is improved during the manufacturing of an iron core. In a case where the arithmetic average roughness (Ra) in the rolling direction is 0.4 μm or less and the arithmetic average roughness (Ra) in the direction perpendicular to the rolling direction is 0.6 μm or less, the space factor of the steel sheet in the iron core is increased, and thus the magnetic characteristics of the laminated iron core are improved. Therefore, the surface roughness of the insulating coating is within a range of 0.1 to 0.4 μm in the rolling direction, and is within a range of 0.3 to 0.6 μm in the direction perpendicular to the rolling direction in terms of arithmetic average roughness (Ra).

The reason why such irregularities are formed on the surface of the insulating coating is presumed to be that, for example, some of fine particles present in the insulating coating applied by a roll coater or the like along the rolling direction and baked is exposed to the surface of the insulating coating.

The arithmetic average roughness is obtained by measurement according to JISB0601:(2013 version).

<Steel Sheet>

The steel sheet to which the insulating coating is to be adhered is not particularly limited as long as it is a grain-oriented electrical steel sheet. For example, a grain-oriented electrical steel sheet manufactured using the technology disclosed in Japanese Unexamined Patent Application, First Publication No. H7-268567, that is, a grain-oriented electrical steel sheet which contains 0.005% or less of C and 2.5% to 7.0% of Si in terms of mass %, has an average grain size of 1 to 10 mm, and in which the crystal orientation has a deviation of orientation of 8° or less on average in the rolling direction with respect to the (110)[001] orientation.

A forsterite layer may be formed on the surface of the steel sheet before the adhesion of the insulating coating. In this case, the insulating coating is formed on a surface of the forsterite layer. It is preferable that the forsterite layer is formed between the steel sheet and the insulating coating since the adhesion between the steel sheet and the insulating coating is improved.

Next, a preferable method of manufacturing a grain-oriented electrical steel sheet according to this embodiment will be described.

In a case where the grain-oriented electrical steel sheet according to this embodiment has the above-described configuration, it achieves effects regardless of the manufacturing method. However, it is preferable that the manufacturing method includes steps of applying a treatment agent to a surface of a steel sheet, performing drying, and performing baking as below since the grain-oriented electrical steel sheet is stably obtained.

The method of manufacturing a steel sheet in which an insulating coating is formed on a surface is not particularly limited. The steel sheet is preferably a grain-oriented electrical steel sheet after final annealing, manufactured by a method disclosed in the prior art, and is more preferably a grain-oriented electrical steel sheet having a known forsterite layer. In addition, after final annealing, it is preferable that the surplus annealing separating agent is removed by water washing, followed by pickling with a sulfuric acid bath or the like and water washing treatment to perform surface washing and surface activation.

For example, a slab containing 2.0 to 4.0 mass % of Si is hot rolled into a hot coil, and the hot coil is cold rolled, or annealed, and then cold rolled into a cold rolled steel sheet having a thickness of about 0.2 to 0.5 mm. The cold rolled steel sheet is subjected to decarburization annealing. Then, in a state in which an annealing separating agent containing MgO as a main component is applied, the cold rolled steel sheet is annealed at a high temperature in a batch furnace up to about 1,200° C. to cause so-called secondary recrystallization and to form a forsterite layer on the surface. After that, a grain-oriented electrical steel sheet obtained by washing the surplus MgO with water may be used as a steel sheet in which an insulating coating is formed on a surface.

To form an insulating coating on the steel sheet, a treatment agent is applied to the surface of the steel sheet, dried, and further baked. The treatment agent for forming an insulating coating according to this embodiment is preferably a treatment agent in which a metal phosphate, a colloidal silica, and fine particles are dispersed in a solvent such as water. Regarding the mixing ratio of each component, the colloidal silica is preferably mixed within a range of 20 to 150 parts by mass with respect to 100 parts by mass of the metal phosphate, and the fine particles are preferably mixed within a range of 0.5 to 7 parts by mass with respect to 100 parts by mass of the metal phosphate, in terms of solid content. Furthermore, boric acid, sodium boride, various oxides such as titanium oxide and molybdenum oxide, a pigment, and inorganic compounds such as barium titanate may be added to the treatment agent. That is, the grain-oriented electrical steel sheet according to this embodiment basically includes a metal phosphate, a colloidal silica, and fine particles, but may contain various oxides or inorganic compounds as described above within the range in which the characteristics are not impaired. Particularly, inorganic compounds such as a pigment are preferable since these have an effect not only of coloring but also of increasing the coating hardness, thereby making it hard to damage the insulating coating.

In order to control the crystallized ratio of the metal phosphate within a desired range and to control the fine particles to be in a predetermined state, the baking conditions for the insulating coating are important.

The temperature rising rate during baking is preferably within a range of 30° C./s to 100° C./s. The crystallized ratio can be easily controlled within a range of 2% to 40% by setting the temperature rising rate within the above range. It is not preferable that the temperature rising rate is lower than 30° C./s since there is a concern that the crystallization may excessively proceed. It is not preferable that the temperature rising rate is higher than 100° C./s since there is a concern that the crystallization may hardly proceed. The temperature rising rate is more preferably within a range of 40° C./s to 70° C./s.

The soaking temperature during baking is preferably within a range of 800° C. to 1,000° C. In a case where the soaking temperature is lower than 800° C., the tension is not sufficiently applied. In a case where the soaking temperature is higher than 1,000° C., there is a concern that the coating tension or the insulation properties may be reduced due to cracks occurring in the insulating coating. The soaking temperature is more preferably within a range of 880° C. to 950° C.

The soaking time is preferably within a range of 10 seconds to 60 seconds. In a case where the soaking holding time is shorter than 10 seconds, there is a concern that moisture absorption properties may deteriorate due to insufficient baking. In a case where the soaking holding time is longer than 60 seconds, the insulating coating is easily damaged. The soaking time is preferably within a range of 15 seconds to 30 seconds.

The steel sheet after baking (after soaking) is cooled to a temperature of 200° C. or lower in a non-oxidizing atmosphere at an average cooling rate of 20° C./s to 100° C./s. The average cooling rate is preferably 50° C./s to 100° C./s.

By baking the insulating coating under these conditions, it is possible to obtain an insulating coating in which the crystallized ratio of a metal phosphate is within a range of 2% to 40% and which contains fine particles within a predetermined range.

The insulating coating according to this embodiment may be formed on a steel sheet having no forsterite layer. In this case, similarly to a case where the steel sheet has a forsterite layer, the surplus annealing separating agent may be removed by water washing, and then pickling with a sulfuric acid bath or the like and water washing treatment may be performed to perform surface washing and surface activation to thus form an insulating coating.

EXAMPLES

Next, examples of the invention will be described. In the examples, conditions are just an example employed to confirm the feasibility and effects of the invention, and the invention is not limited to this example. The invention can employ various conditions as long as the object of the invention is achieved without deviating from the gist of the invention.

A slab was manufactured by casting molten steel containing 3.2 mass % of Si, 0.027 mass % of Al, 0.008 mass % of N, and 0.08 mass % of C. The slab was heated to be hot rolled to obtain a hot rolled steel sheet. The hot rolled steel sheet was annealed at 1,100° C. for 5 minutes, and then cooled. The hot rolled steel sheet after the annealing was cold rolled to obtain a cold rolled steel sheet having a thickness of 0.23 mm. After that, the cold rolled steel sheet was subjected to decarburization annealing at 850° C. for 3 minutes, and an annealing separating agent containing MgO as a main component was applied. Then, the cold rolled steel sheet was subjected to final annealing for 20 hours at 1,200° C. A sample with a width of 7 cm and a length of 32 cm was cut out from the cold rolled steel sheet after the final annealing, and while the forsterite layer was allowed to remain, the annealing separating agent remaining on the surface was removed by water washing. Then, stress relief annealing was performed to obtain a steel sheet.

The obtained steel sheet contained 0.001 mass % of C and 3.2 mass % of Si. In the structure, the average grain size was 1 to 10 mm, and the crystal orientation had a deviation of orientation of 8° or less on average in a rolling direction with respect to the (110)[001] orientation.

Next, using fine particles shown in Table 1, a metal phosphate solution was prepared with a mixing ratio shown in Table 2, and then applied to the steel sheet with a roll coater such that the coating amount was 4.5 g/m$^2$. The solution was baked under conditions described in Table 2, and cooled to a temperature of 200° C. or lower in a non-oxidizing atmosphere to obtain grain-oriented electrical steel sheets of Examples 1 to 12 and Comparative Examples 1 to 13. The surface roughness, the coating characteristics, and the magnetic characteristics of the obtained grain-oriented electrical steel sheets were evaluated. The results are shown in Tables 2 and 3.

For boron nitride, aluminum nitride, silicon nitride, silicon carbide, alumina, sialon, and boehmite, commercially available products with respective particle sizes were used. Regarding cordierite, powders of magnesium carbonate, kaolinite, and quartz were combined to obtain a cordierite composition, and after the powders were mixed, baking was performed, and then pulverization was performed to obtain a predetermined particle size. Regarding mullite, alumina and quartz powders were combined to obtain a mullite composition, mixed, stirred, and then baked. Then, pulverization was performed to obtain a predetermined particle size. The used colloidal silica had an average particle size of 15 nm.

As the surface roughness, an arithmetic average roughness Ra was measured in the rolling direction and in the direction perpendicular to the rolling direction based on JISB0601 (2013).

The coating characteristic evaluation methods are as follows.

Regarding adhesion, Sellotape (registered trademark) was adhered to a steel sheet sample of 30 mm×200 mm, and then wound and bent around a round bar having a diameter of 10 mm4), a round bar having a diameter of 20 mmϕ, and a round bar having a diameter of 30 mmϕ. Then, the Sellotape (registered trademark) was peeled off to observe the peeling state. The peeling state was evaluated on a scale of 0 to 30 as follows, and judged to be acceptable in a case where the point is 10 or lower.

0: No peeling even on round bar of 10 mmϕ

10: peeling on round bar of 10 mmϕ

20: peeling on round bar of 20 mmϕ

30: peeling on round bar of 30 mmϕ

The corrosion resistance was evaluated by a 5% salt spray test. The exposure time was 10 hours, and the rusting state was evaluated on a scale of 1 to 10. 10 points were given in a case where no rusting occurred, and 1 point was given in a case where the area ratio of rust was 50%. Rusting states with 7 points or higher were accepted.

The coating tension was calculated by calculating backward from the bending state when one side of the insulating coating was peeled off.

The crystallized ratio of the metal phosphate was measured by a profile fitting method described in Japanese Patent No. 5063902. First, X-ray diffraction measurement (measurement using Cu as an X-ray target) of the insulating coating was performed to obtain a diffraction diagram. In the diffraction diagram, the amorphous halo as an amorphous component appears near 2θ=20°, and the metal phosphate as a crystalline component appears as a main peak. For example, in the case of Ni phosphate, a main peak appears near 30°. From the peaks of the amorphous component and the crystalline component, the background was separated to obtain the respective scattering intensities, and crystallized ratio X (%) was calculated using the following expression. Since the colloidal silica also contained the amorphous component, amorphous scattering intensity A was corrected by calculating the contribution of the amorphous halo from the colloidal silica content.

$X=C/(C+A)\times 100$

C: crystalline scattering intensity A: amorphous scattering intensity

As the magnetic characteristics, B8 and W17/50 were obtained by a method based on JIS C 2550.

TABLE 1

| Fine Particles | Name | Chemical Formula | Crystal System | Average Particle Size (μm) |
|---|---|---|---|---|
| A | Boron Nitride | BN | Hexagonal | 0.5 |
| B | Boron Nitride | BN | Hexagonal | 11.0 |
| C | Boron Nitride | BN | Hexagonal | 0.2 |
| D | Aluminum Nitride | AIN | Hexagonal | 1.1 |
| E | Aluminum Nitride | AIN | Hexagonal | 9.0 |
| F | Silicon Nitride | $Si_3N_4$ | Hexagonal | 4.2 |
| G | Alumina | $Al_2O_3$ | Hexagonal | 4.6 |
| H | Cordierite | $2Al_2O_3 \bullet 2MgO \bullet 5SiO_2$ | Hexagonal | 3.6 |
| I | Sialon | $Si_3O_4 \bullet Al_2O_3$ | Cubic | 5.0 |
| J | Mullite | $3Al_2O_3 \bullet 2SiO_2$ | Orthorhombic | 5.0 |
| K | Boehmite | AlO(OH) | Trigonal | 6.1 |
| L | Silicon Carbide | SiC | Hexagonal | 0.7 |

The underline indicates that the underlined substance or numerical value is out of the scope of the invention.

TABLE 2

| | 100 Parts by Mass of Metal Phosphate* Kind: Ratio (mass %) | Silica Content in Colloidal Silica** Parts by Mass | Added Fine Particles Kind | Added Fine Particles Parts by Mass | Baking Conditions: Temperature Rising Rate ° C./sec | Baking Conditions: Soaking Temperature ° C. | Baking Conditions: Soaking Time sec | Baking Conditions: Cooling Rate ° C./sec |
|---|---|---|---|---|---|---|---|---|
| Example 1 | Al: 75, Mg: 25 | 50 | A | 2 | 40 | 860 | 15 | 80 |
| Example 2 | Al: 95, Mg: 5 | 45 | A | 3 | 60 | 900 | 15 | 60 |
| Example 3 | Al: 100 | 40 | F | 4 | 60 | 900 | 15 | 80 |
| Example 4 | Al: 45, Zn: 55 | 35 | F | 5 | 70 | 900 | 30 | 50 |
| Example 5 | Al: 70, Ni: 30 | 50 | H | 6 | 90 | 900 | 30 | 100 |
| Example 6 | Al: 55, Mn: 45 | 40 | I | 0.8 | 40 | 850 | 30 | 80 |
| Example 7 | Al: 75, Zn: 25 | 55 | D | 3 | 40 | 920 | 55 | 80 |
| Example 8 | Al: 85, Co15 | 50 | L | 3 | 60 | 880 | 55 | 60 |
| Example 9 | Al: 100 | 50 | L | 3 | 60 | 880 | 30 | 60 |
| Example 10 | Al: 90, Fe: 10 | 50 | H | 1 | 60 | 850 | 30 | 60 |
| Example 11 | Al: 97, Ba: 3 | 40 | I | 1.5 | 40 | 850 | 30 | 50 |
| Example 12 | Mg: 75, Ni: 25 | 50 | A | 2 | 40 | 860 | 30 | 50 |
| Comparative Example 1 | Al: 50, Mg: 50 | 40 | A | 0.3 | 40 | 840 | 30 | 50 |
| Comparative Example 2 | Al: 100 | 40 | A | 10 | 40 | 800 | 120 | 100 |
| Comparative Example 3 | Al: 75, Mg: 25 | 40 | C | 2 | 40 | 880 | 15 | 100 |
| Comparative Example 4 | Al: 100 | 45 | B | 3 | 60 | 800 | 15 | 60 |
| Comparative Example 5 | Al: 75, Mg: 25 | 40 | E | 4 | 60 | 900 | 15 | 60 |
| Comparative Example 6 | Al: 75, Mg: 25 | 40 | F | 0.2 | 60 | 880 | 30 | 60 |
| Comparative Example 7 | Al: 100 | 40 | I | 11 | 40 | 880 | 30 | 100 |
| Comparative Example 8 | Al: 75, Mg: 25 | 170 | D | 3 | 40 | 880 | 10 | 50 |
| Comparative Example 9 | Al: 100 | 15 | D | 3 | 40 | 880 | 30 | 60 |
| Comparative Example 10 | Al: 100 | 40 | G | 5 | 40 | 800 | 30 | 60 |
| Comparative Example 11 | A1: 100 | 40 | J | 3 | 40 | 840 | 30 | 60 |
| Comparative Example 12 | Al: 100 | 40 | K | 4 | 40 | 840 | 30 | 60 |
| Comparative Example 13 | Al: 100 | 40 | — | 0 | 40 | 840 | 10 | 50 |

TABLE 2-continued

| | Surface Roughness | | Additive | |
|---|---|---|---|---|
| | Rolling Direction L Ra (μm) | Direction C Perpendicular to Rolling Direction Ra (μm) | Kind | Parts by Mass |
| Example 1 | 0.20 | 0.35 | — | |
| Example 2 | 0.15 | 0.33 | Phosphonic Acid | 10 |
| Example 3 | 0.21 | 0.34 | Phosphonic Acid | 10 |
| Example 4 | 0.13 | 0.31 | Boric Acid | 5 |
| Example 5 | 0.26 | 0.41 | — | |
| Example 6 | 0.25 | 0.34 | — | |
| Example 7 | 0.23 | 0.47 | — | |
| Example 8 | 0.17 | 0.33 | Phosphonic Acid | 10 |
| Example 9 | 0.15 | 0.36 | Boric Acid | 5 |
| Example 10 | 0.14 | 0.36 | — | |
| Example 11 | 0.16 | 0.33 | — | |
| Example 12 | 0.13 | 0.29 | — | |
| Comparative Example 1 | 0.13 | 0.28 | — | |
| Comparative Example 2 | 0.34 | 0.67 | — | |
| Comparative Example 3 | 0.36 | 0.71 | — | |
| Comparative Example 4 | 0.18 | 0.36 | — | |
| Comparative Example 5 | 0.17 | 0.41 | — | |
| Comparative Example 6 | 0.14 | 0.29 | — | |
| Comparative Example 7 | 0.36 | 0.51 | — | |
| Comparative Example 8 | 0.12 | 0.28 | — | |
| Comparative Example 9 | 0.18 | 0.31 | — | |
| Comparative Example 10 | 0.16 | 0.31 | — | |
| Comparative Example 11 | 0.17 | 0.28 | — | |
| Comparative Example 12 | 0.19 | 0.33 | — | |
| Comparative Example 13 | 0.14 | 0.27 | — | |

The underline indicates that the underlined substance or numerical value is out of the scope or the preferable scope of the invention.
*The phosphate in Table 2 was adjusted such that the solid content thereof was 40 wt %, and mixed such that the ratio of each metal element in the phosphate was as in the table.
**As the colloidal silica in Table 2, a commercially available colloidal silica solution having a concentration of 30 wt % was used.

In each case, the treatment liquid was prepared such that the silica content was as shown in the table (parts by mass) with respect to 100 parts by mass of the phosphate in terms of solid content in the coating.

TABLE 3

| | Components of Insulating Coating | | | Insulating Coating Characteristics | |
|---|---|---|---|---|---|
| | Crystallized ratio of Phosphate (%) | Amount of Fine Particles Added (parts by mass) | Adhered Amount of Insulating Coating ($g/m^2$) | Adhesion | Corrosion Resistance |
| Example 1 | 30 | 2 | 4.3 | 0 | 10 |
| Example 2 | 25 | 3 | 4.6 | 0 | 10 |
| Example 3 | 15 | 4 | 4.4 | 0 | 9 |
| Example 4 | 20 | 5 | 4.3 | 0 | 9 |
| Example 5 | 15 | 6 | 4.5 | 0 | 9 |
| Example 6 | 35 | 0.8 | 4.6 | 0 | 9 |
| Example 7 | 15 | 3 | 4.4 | 0 | 9 |
| Example 8 | 10 | 3 | 4.3 | 0 | 10 |
| Example 9 | 5 | 3 | 4.4 | 0 | 9 |
| Example 10 | 10 | 1 | 4.4 | 10 | 9 |
| Example 11 | 10 | 1.5 | 4.4 | 0 | 9 |
| Example 12 | 35 | 2.0 | 4.5 | 0 | 10 |

TABLE 3-continued

| | | | | | |
|---|---|---|---|---|---|
| Comparative Example 1 | 30 | 0.3 | 4.5 | 0 | 10 |
| Comparative Example 2 | 45 | 10 | 4.6 | 30 | 8 |
| Comparative Example 3 | 50 | 2 | 4.7 | 10 | 8 |
| Comparative Example 4 | 10 | 3 | 4.3 | 30 | 8 |
| Comparative Example 5 | 10 | 4 | 4.5 | 20 | 8 |
| Comparative Example 6 | 10 | 0.2 | 4.7 | 10 | 10 |
| Comparative Example 7 | 50 | 11 | 4.6 | 30 | 6 |
| Comparative Example 8 | 0 | 3 | 4.5 | 20 | 7 |
| Comparative Example 9 | 10 | 3 | 4.6 | 0 | 9 |
| Comparative Example 10 | 10 | 5 | 4.5 | 10 | 7 |
| Comparative Example 11 | 5 | 3 | 4.6 | 10 | 8 |
| Comparative Example 12 | 10 | 4 | 4.3 | 10 | 6 |
| Comparative Example 13 | 0 | 0 | 4.5 | 0 | 10 |

| | Insulating Coating Characteristics | Magnetic Characteristics | | Remarks Stability of Treatment |
|---|---|---|---|---|
| | Coating Tension (kgf/mm$^2$) | B8 (T) | W 17/50 (W/kg) | Liquid, Surface Appearance, etc. |
| Example 1 | 0.92 | 1.92 | 0.76 | Uniform and Beautiful |
| Example 2 | 0.97 | 1.93 | 0.73 | Uniform and Beautiful |
| Example 3 | 0.93 | 1.91 | 0.75 | Significantly High Uniformity |
| Example 4 | 0.89 | 1.92 | 0.75 | Glossy and Uniform |
| Example 5 | 0.87 | 1.92 | 0.78 | Uniform Color Tone |
| Example 6 | 0.93 | 1.92 | 0.76 | Significantly High Uniformity |
| Example 7 | 0.94 | 1.93 | 0.78 | Uniform Color Tone |
| Example 8 | 0.89 | 1.92 | 0.75 | Glossy and Uniform |
| Example 9 | 0.86 | 1.93 | 0.78 | Glossy and Uniform |
| Example 10 | 0.88 | 1.92 | 0.79 | Uniform Color Tone |
| Example 11 | 0.86 | 1.93 | 0.78 | Uniform Color Tone |
| Example 12 | 0.89 | 1.92 | 0.77 | Significantly High Uniformity |
| Comparative Example 1 | 0.74 | 1.93 | 0.84 | Glossy and Uniform |
| Comparative Example 2 | 0.65 | 1.89 | 0.81 | Light Gray and Non-Uniform |
| Comparative Example 3 | 0.79 | 1.93 | 0.81 | Not Glossy, but Uniform |
| Comparative Example 4 | 0.63 | 1.92 | 0.86 | Whitish and Non-Uniform |
| Comparative Example 5 | 0.81 | 1.92 | 0.81 | Whitish and Non-Uniform |
| Comparative Example 6 | 0.76 | 1.92 | 0.82 | Glossy and Uniform |
| Comparative Example 7 | 0.73 | 1.93 | 0.81 | White and Non-Uniform |
| Comparative Example 8 | 0.51 | 1.93 | 0.89 | Not Glossy, but Uniform |
| Comparative Example 9 | 0.41 | 1.93 | 0.94 | Glossy and Non-Uniform |
| Comparative Example 10 | 0.65 | 1.91 | 0.91 | White and Non-Uniform |
| Comparative Example 11 | 0.81 | 1.93 | 0.82 | Not Glossy, but Uniform |
| Comparative Example 12 | 0.63 | 1.91 | 0.92 | Not Glossy, but Uniform |
| Comparative Example 13 | 0.79 | 1.93 | 0.84 | Glossy and Uniform |

As a result of the tests, as shown in Table 3, the electrical steel sheets (Examples 1 to 12) having a chromium-free insulating coating in a surface, which contained a metal phosphate and a colloidal silica as main components, and in which the colloidal silica was contained in an amount of 20 to 150 parts by mass with respect to 100 parts by mass of the metal phosphate, and one or more kinds of fine particles selected from the group consisting of silicon carbide, silicon nitride, aluminum nitride, boron nitride, sialon, and cordierite are contained in an amount of 0.5 to 7 parts by mass with respect to 100 parts by mass of the metal phosphate had a higher coating tension, were more excellent in adhesion and corrosion resistance of the insulating coating, and had a more remarkable magnetic characteristic improvement effect than in Comparative Examples 1 to 13.

INDUSTRIAL APPLICABILITY

According to the invention, it is possible to provide a grain-oriented electrical steel sheet which has a coating having various good coating characteristics such as adhesion and corrosion resistance and capable of applying a significantly higher tension to the steel sheet than in conventional cases despite not containing chromium, and has good magnetic characteristics.

What is claimed is:

1. A grain-oriented electrical steel sheet comprising:

a steel sheet; and an insulating coating which is formed on a surface of the steel sheet, wherein in the insulating coating, a metal phosphate and a colloidal silica are contained, the colloidal silica is contained in an amount of 40 to 55 parts by mass with respect to 100 parts by mass of the metal phosphate, one or more kinds of fine particles selected from the group consisting of silicon carbide, silicon nitride, aluminum nitride, boron nitride, sialon, and cordierite are further contained in an amount of 0.5 to 7 parts by mass with respect to 100 parts by mass of the metal phosphate, an average particle size of the fine particles is 3.6 to 7.0 μm, crystallized ratio of the metal phosphate is 2% to 40%, and chromium is not contained.

2. The grain-oriented electrical steel sheet according to claim 1, wherein the metal phosphate is one or more of metal salts selected from the group consisting of Al, Ba, Co, Fe, Mg, Mn, Ni, and Zn.

3. The grain-oriented electrical steel sheet according to claim 1 or 2, wherein an arithmetic average roughness Ra of the insulating coating is within a range of 0.1 to 0.4 μm in a rolling direction, and is within a range of 0.3 to 0.6 μm in a direction perpendicular to the rolling direction.

4. The grain-oriented electrical steel sheet according to claim 1 or 2, wherein the steel sheet contains 0.005% or less of C and 2.5% to 7.0% of Si in terms of mass %, and in a structure of the steel sheet, an average grain size is 1 to 10 mm, and crystal orientation has a deviation of orientation of 8° or less on average in a rolling direction with respect to (110)[001] orientation.

5. The grain-oriented electrical steel sheet according to claim 1 or 2, further comprising:

a forsterite layer which is provided between the steel sheet and the insulating coating.

6. The grain-oriented electrical steel sheet according to claim 3, wherein the steel sheet contains 0.005% or less of C and 2.5% to 7.0% of Si in terms of mass %, and in a structure of the steel sheet, an average grain size is 1 to 10 mm, and crystal orientation has a deviation of orientation of 8° or less on average in a rolling direction with respect to (110)[001] orientation.

7. The grain-oriented electrical steel sheet according to claim 3, further comprising:

a forsterite layer which is provided between the steel sheet and the insulating coating.

8. The grain-oriented electrical steel sheet according to claim 4, further comprising:

a forsterite layer which is provided between the steel sheet and the insulating coating.

9. The grain-oriented electrical steel sheet according to claim 6, further comprising:

a forsterite layer which is provided between the steel sheet and the insulating coating.

10. The grain-oriented electrical steel sheet according to claim 1, wherein a crystal system of the fine particles is hexagonal or cubic.

* * * * *